US010822849B1

(12) United States Patent
Musgrave

(10) Patent No.: US 10,822,849 B1
(45) Date of Patent: Nov. 3, 2020

(54) DOOR LOCKING SYSTEM

(71) Applicant: Jimmy Musgrave, Dallas, TX (US)

(72) Inventor: Jimmy Musgrave, Dallas, TX (US)

( * ) Notice: Subject to any disclaimer, the term of this patent is extended or adjusted under 35 U.S.C. 154(b) by 0 days.

(21) Appl. No.: 16/672,742

(22) Filed: Nov. 4, 2019

Related U.S. Application Data

(60) Provisional application No. 62/894,346, filed on Aug. 30, 2019.

(51) Int. Cl.
*E05C 19/00* (2006.01)
*E05C 1/04* (2006.01)

(52) U.S. Cl.
CPC ..... *E05C 19/003* (2013.01); *E05C 1/04* (2013.01)

(58) Field of Classification Search
CPC ... E05C 1/004; E05C 1/04; E05C 5/00; E05C 5/02; E05C 17/12; E05C 17/20; E05C 17/44; E05C 19/003; E05C 17/48; E05B 15/0053; E05B 15/008; E05B 63/0004; Y10S 292/15; Y10S 292/44; Y10S 292/29; Y10S 292/51; Y10T 292/0863; Y10T 292/0869; Y10T 292/0886; Y10T 292/0893; Y10T 292/0918; Y10T 292/0913; Y10T 292/0936; Y10T 292/0951; Y10T 292/0953; Y10T 292/0999; Y10T 292/10; Y10T 292/1024;
(Continued)

(56) References Cited

U.S. PATENT DOCUMENTS 1,086,749 A * 2/1914 Brenneman ..... E05B 65/0864 292/175
1,355,371 A * 10/1920 Welsh ..... E05C 17/446 292/57

(Continued)

FOREIGN PATENT DOCUMENTS

GB 191010061 A * 12/1910 ..... E05C 17/446
GB 147911 A * 10/1921 ..... E05C 5/00
GB 344249 A * 3/1931 ..... E05C 1/04

OTHER PUBLICATIONS

Crown Industrial, Cane Bolt 5/8'×18' Spring Hold Up or Down Assembly, http://docs.crown-industrial.com/PDF/524P21SPU.pdf and http://docs.crown-industrial .com/PDF/524P21SPD .pdf, Jul. 21, 2015.

(Continued)

*Primary Examiner* — Christine M Mills
(74) *Attorney, Agent, or Firm* — Scott Griggs; Griggs Bergen LLP

(57) ABSTRACT

A door locking system is disclosed for integrating into an entry door having a door hardware extension therein and a door sill. The door locking system includes a continuous cane rod that transitions from an open configuration to a locked configuration by radial displacement of a handle of the continuous cane rod away from an upper retention member, vertical displacement of a shaft of the continuous cane rod such that a heel penetrates a receiving member, and radial displacement of the handle of the continuous cane rod to a lower retention member such that the handle is releasably retained by the lower retention member. The continuous cane rod transitions from the locked to the open configuration in the opposite manner. The door locking system provides a reinforced entry door in the locked configuration.

7 Claims, 2 Drawing Sheets

(58) Field of Classification Search
CPC ..... Y10T 292/65; Y10T 292/1022; Y10T 292/42; Y10T 292/0867
USPC ..... 292/57, 62, 63, 69, 114, 109, 129, 101, 292/103, 177, 178, 147, 338, 145, 292/DIG. 15, DIG. 44, DIG. 29, 300, 292/DIG. 51, 60; 248/351
See application file for complete search history.

(56) References Cited

U.S. PATENT DOCUMENTS 1,448,298 A * 3/1923 Hight ..... E05C 1/14 16/83
1,628,502 A * 5/1927 Letzau ..... E05C 17/446 292/175
1,723,007 A * 8/1929 Bittorf ..... E05B 17/2076 292/57
1,792,540 A * 2/1931 Johnson ..... E05C 1/04 292/57
D396,795 S * 8/1998 Francom ..... D8/339
5,983,680 A * 11/1999 Del Nin ..... E05C 17/38 16/82
7,766,400 B2 * 8/2010 Predebon ..... E05C 17/54 16/82
8,250,811 B2 * 8/2012 Zijlstra ..... E05C 1/10 292/57
8,844,201 B2 * 9/2014 Robinson ..... E05D 7/12 49/394
9,187,931 B2 11/2015 Hudson et al.
9,238,926 B2 * 1/2016 Guerrero ..... E05B 17/2076

OTHER PUBLICATIONS

GateLatchUSA, 5/8'×24' Lockable Engaged Stainless Steel Cane Bolt, https://www.gatelatchusacom/cane-bolt-details-lockable-engaged.html.
Zeppy.io, Drop Bolt Heavy Duty Spring Loaded Stable Door Gate Garage Garden Shed New, http://www.zeppy.io/product/gb/2/261265047269/drop-bolt-heavy-duty-spring-loaded-stable-door-gate-garage-garden-shed-new.

* cited by examiner

DOOR LOCKING SYSTEM

PRIORITY STATEMENT & CROSS REFERENCE TO RELATED APPLICATIONS

This application claims priority from U.S. Patent Application No. 62/894,346 entitled "Door Locking System" filed on Aug. 30, 2019, in the name of Jimmy Musgrave; which is hereby incorporated by reference in its entirety for all purposes.

TECHNICAL FIELD OF THE INVENTION

This invention relates, in general, to door locking systems and, in particular, to a door locking system for integrating into an entry door having a hardware therein and a door sill.

BACKGROUND OF THE INVENTION

A home invasion by a criminal or criminals is a life-threatening, traumatic experience involving the loss of property and violence against the residents of the home. Ingress and egress points like doors are often entry points for home invasions. There is a need for more secure doors that mitigate the risk of forced entry and protect against forced entry attempts.

SUMMARY OF THE INVENTION

It would be advantageous to provide a door locking system that integrates into an existing entry door having a hardware therein and a door sill. It would also be desirable to enable a mechanical-based solution providing a secure door that would mitigate the risk of forced entry and protect against forced entry attempts. To better address one or more of these concerns, a door locking system is disclosed for integrating into an entry door having door hardware therein and a door sill. In one embodiment, the door locking system includes a continuous cane rod that transitions from an open configuration to a locked configuration by radial displacement of a handle of the continuous cane rod away from an upper retention member, vertical displacement of a shaft of the continuous cane rod such that a heel penetrates a receiving member, and radial displacement of the handle of the continuous cane rod to a lower retention member such that the handle is releasably retained by the lower retention member. The continuous cane rod transitions from the locked to the open configuration in the opposite manner. The door locking system provides a reinforced entry door in the locked configuration. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
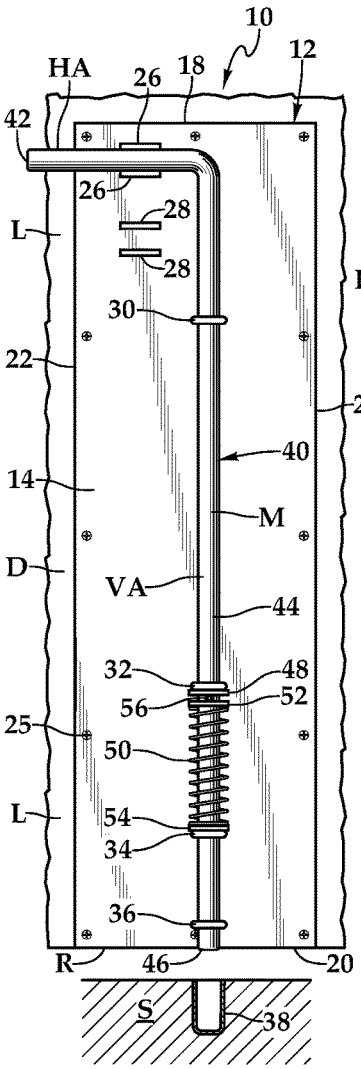
FIG. 1 is a front elevation view of one embodiment of a door locking system in an open configuration according to the teachings presented herein.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring to FIG. 1 through FIG. 8, therein is depicted a door locking system that is schematically illustrated and generally designated 10. As shown, the door locking system 10 is integrated into an entry door D having a door hardware extension H therein, such as a doorknob or a door handle, and a door sill S. A mounting plate 12 includes a front surface 14, a rear surface 16, an upper edge 18, a lower edge 20, and two side edges 22, 24. The rear surface 16 of the mounting plate 12 is configured to be mounted to the entry door D proximate an intersection of a lock stile L and a bottom rail R with fasteners 25, which may be screws or the like. The mounting plate 12 may be an 11/32" (8.7 mm) steel plate. An upper retention member 26 is coupled to the front surface 14 of the mounting plate 12 and may be welded thereto. A lower retention member 28 is also coupled to the front surface 14 of the mounting plate 12 and may be welded thereto.

As shown, guide members 30, 32, 34, 36 may be coupled to the front surface 14 of the mounting plate 12 by welding, for example, from the lower edge 20 to the upper edge 18. The guide members 30, 32, 34, 36 are, in one embodiment, vertically aligned. In the illustrated embodiment, each of the guide members 30, 32, 34, 36 is an eyebolt. The upper retention member 26 is superposed to the lower retention member 28 and the guide members 30, 32, 34, 36. The upper retention member 26 is laterally offset from the guide members 30, 32, 34, 36. The lower retention member 28 is superposed to the guide members 30, 32, 34, 36, and the lower retention member 28 is laterally offset from the guide members 30, 32, 34, 36.

A receiving member 38 is configured to be mounted in the door sill S and the receiving member 38 is vertically aligned with the guide members 30, 32, 34, 36. A continuous cane rod 40 has a handle 42 coupled to a shaft 44 having a heel 46. As shown, the handle 42 has a horizontal axis HA and the shaft 44 has a vertical axis VA having a midpoint M. The continuous cane rod 40 may be a ½" (12.7 mm) steel rod. A spring washer 48 is mounted on the continuous cane rod 40 subjacent to the guide member 32. A spring 50 is mounted on the continuous cane rod 40 and interposed between the guide member 34 and the spring washer 48. In one embodiment, the spring 50 may have additional washers 52, 54 at each end. Further, a pin 56 may hold the spring 50 in place. The spring 50 urges the continuous cane rod 40 axially and vertically along the vertical axis VA toward the upper retention member 26 until the spring 50 urges the spring washer 48 into contact with the guide member 32. The spring washer 48 dampens the contact between the spring 50 and the guide member 32. As shown, one of the guide members, guide member 30, is superior to the midpoint M of the shaft 44 of the continuous cane rod 40, and three of the guide members, guide members 32, 34, 36, are inferior to the midpoint M. It should be appreciated that although the mounting plate 12 is depicted as being mounted to the entry door D proximate an intersection of a lock stile L and a bottom rail R, the mounting plate 12 may be mounted in other locations. By way of example and not by way of limitation, the mounting plate 12 may be mounted at an intersection of a hinge stile and the bottom rail R. Further still, the orientation of the door locking system 10 may be inverted and the mounting plate 12 may be mounted on the entry door D at an intersection of a top rail and the hinge stile or at an intersection of the top rail and the lock stile L. With the various mounting configurations of the door locking system 10 and the mounting plate 12, the door locking system 10 may be employed at the top or bottom of an entry door and the door locking system 10 accommodates left-handed and right-handed opening entry doors as well as other types of doors.

Figure 2:
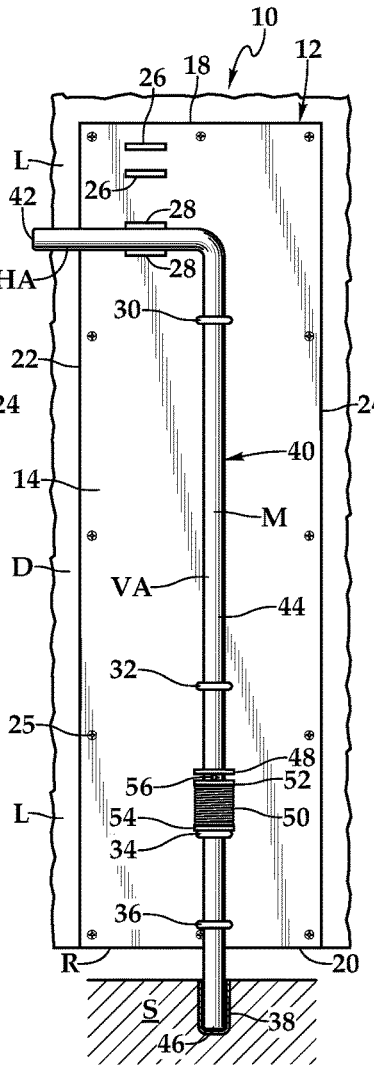
FIG. 2 is a front elevation view of the door locking system depicted in FIG. 1 in a closed configuration.
Figure 4:
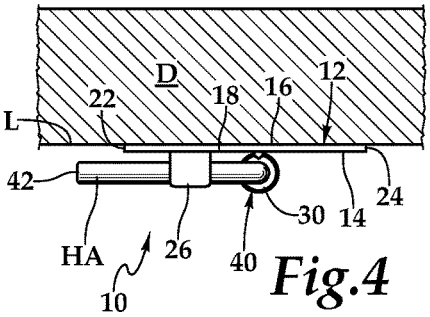
FIG. 4 is a top plan view of the door locking system depicted in FIG. 1 in the open configuration.
Figure 6:
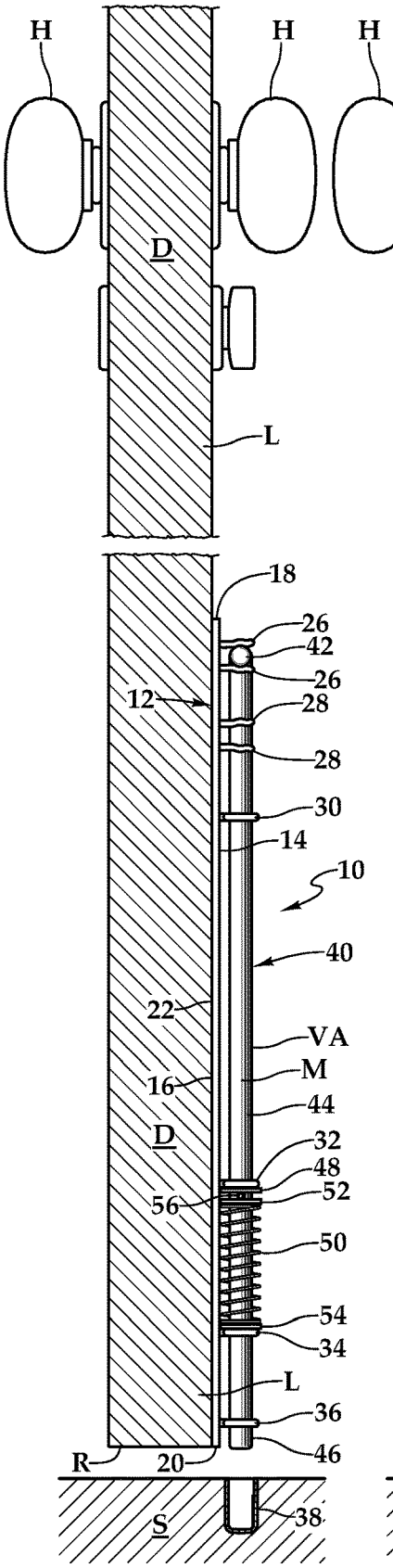
FIG. 6 is a left-side elevation view of the door locking system depicted in FIG. 1 in the open configuration.
Figure 7:
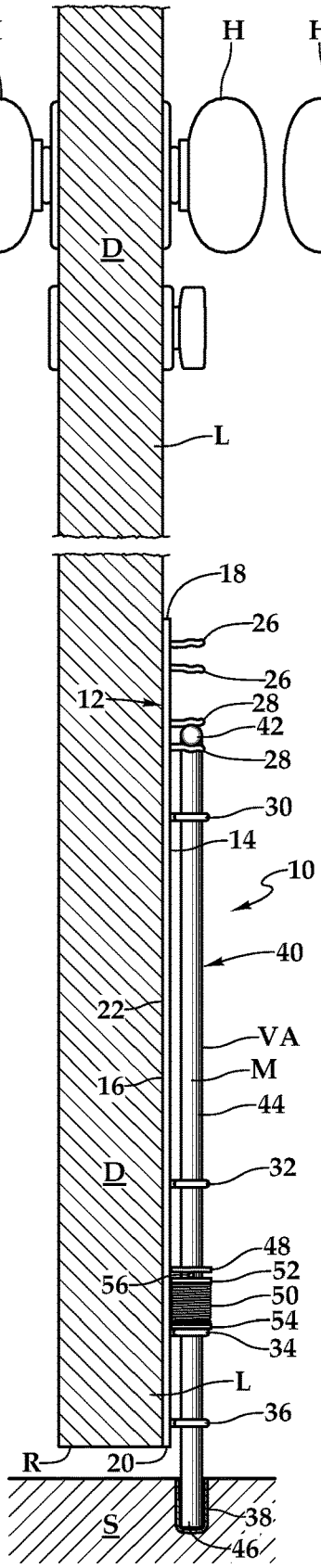
FIG. 7 is a left-side elevation view of the door locking system depicted in FIG. 2 in the closed configuration.

Referring now to FIG. 1, FIG. 4, and FIG. 6, in an open configuration, the handle 42 of the continuous cane rod 40 is releasably retained by the upper retention member 26 with the shaft 44 slidably extending axially through the guide members 30, 32, 34, 36 with the heel 46 of the continuous cane rod 40 spatially separated from the receiving member 38. Referring now to FIG. 2 and FIG. 7, on the other hand, in a locked configuration, the handle 42 of the continuous cane rod 40 is releasably retained by the lower retention member 28 with the shaft 44 slidably extending axially through the guide members 30, 32, 34, 36 with the heel 46 of the continuous cane rod 40 penetrating the receiving member 38.

Figure 3:
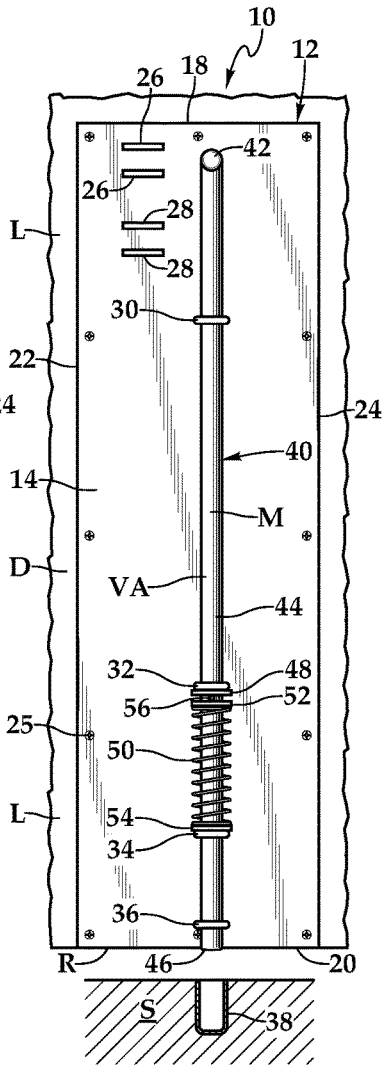
FIG. 3 is a front elevation view of the door locking system depicted in FIG. 1 transitioning between the open configuration and the closed configuration.
Figure 5:
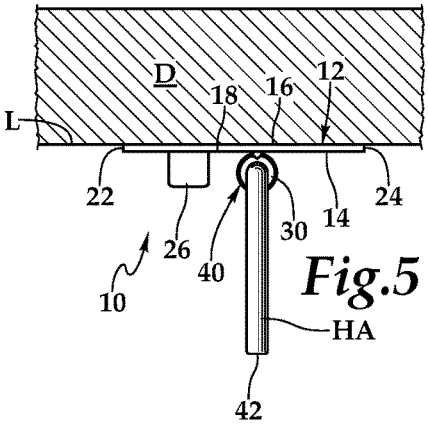
FIG. 5 is a top plan view of the door locking system depicted in FIG. 3 transitioning between the open configuration and the closed configuration.
Figure 8:
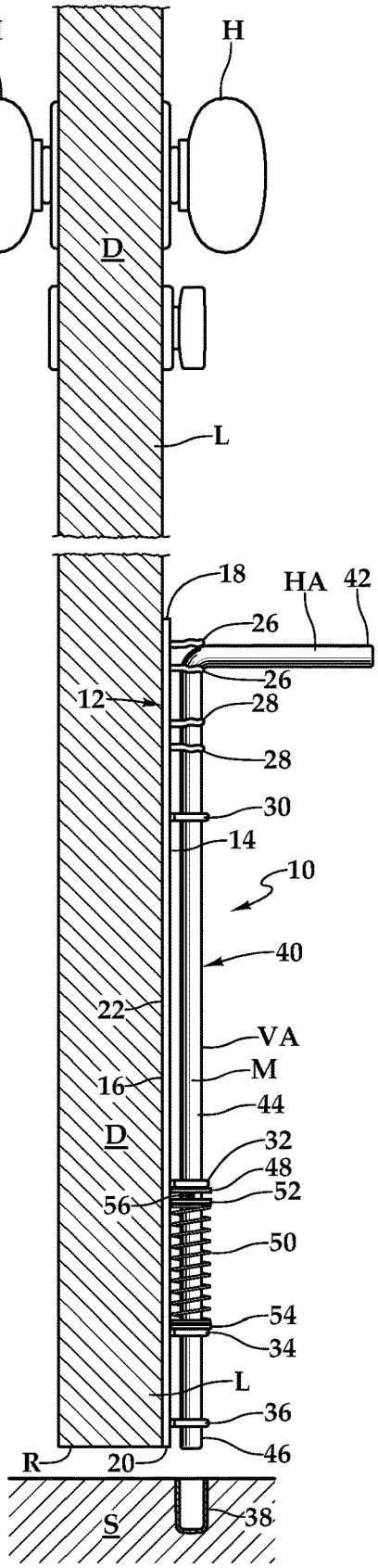
FIG. 8 is a left-side elevation view of the door locking system depicted in FIG. 3 transitioning between the open configuration and the closed configuration.

Referring now to FIG. 3, FIG. 5, and FIG. 8, in operation, the continuous cane rod 40 transitions from the open configuration of FIG. 1, FIG. 4, and FIG. 6 to the locked configuration of FIG. 2 and FIG. 7 by radial displacement on the horizontal axis HA of the handle of the continuous cane rod 40 away from the upper retention member 26 followed by vertical displacement of the shaft 44 along the vertical axis VA such that the heel 46 penetrates the receiving member 38. To complete the transition from the open configuration to the locked configuration, the handle 42 of the continuous cane rod 40 is radially displaced on the horizontal axis HA to the lower retention member 28 such that the handle 42 is releasably retained by the lower retention member 28.

The continuous cane rod 40 transitions from the locked configuration of FIG. 2 and FIG. 7 to the open configuration of FIG. 1, FIG. 4, and FIG. 6 by radial displacement of the handle 42 of the continuous cane rod 40 on the horizontal axis HA away from the lower retention member 28 followed by vertical displacement of the shaft 44 along the vertical axis VA such that the heel 46 retreats from the receiving member 38 with a spatial separation therebetween. This is followed by the radial displacement of the handle 42 of the continuous cane rod 40 on the horizontal axis HA toward the upper retention member 26 such that the handle 42 is releasably retained by the upper retention member 26.

The door locking system 10 presented herein provides a mechanical-based solution furnishing a secure entry door D that mitigates the risk of forced entry and protects against forced entry attempts. In some embodiments, the mounting plate 12, in combination with the welded eyebolts serving as four guide members 30, 32, 34, 36, distributes and dissipates the force of a forced entry attempt such that the integrity of the door locking system 10 and the entry door D is maintained. In particular, with one guide member 30 superior to the midpoint M of the shaft 44 and the guide members 32, 34, 36 inferior to the midpoint M of the shaft 44 of the continuous cane rod 40, the continuous cane rod 40 has sufficient support and strength at points of contact near the heel 46 to resist forced entry in the closed configuration. Further, ease of use and convenience are found with the door locking system 10. The upper retention member 26 and lower retention member 28 provide a compact form factor to the door locking system 10 to ensure the handle 42 of the continuous cane rod 40 does not catch on any object. With this design, the door locking system 10 is not only inconspicuous but the handle 42 may be easily rotated and the continuous cane rod 40 actuated with the assistance of the spring 50, with the spring washer 48 sufficiently dampening any noise. As a result, home owners are given increased safety and peace of mind by the door locking system 10.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A door locking system for integrating into an entry door having a hardware therein and a door sill, the door locking system comprising:

a mounting plate including a front surface, a rear surface, an upper edge, a lower edge, and two side edges, the rear surface of the mounting plate configured to be mounted to the entry door proximate an intersection of a lock stile and a bottom rail;

an upper retention member coupled to the front surface of the mounting plate, the upper retention member including upper and lower planar parallel plates, the upper and lower planar parallel plates configured to releasably retain a handle of a continuous cane rod therebetween;

a lower retention member coupled to the front surface of the mounting plate, the lower retention member including upper and lower planar parallel plates, the upper and lower planar parallel plates configured to releasably retain the handle of the continuous cane rod therebetween;

a plurality of guide members including first, second, third, and fourth guide members coupled to the front surface of the mounting plate, the first, second, third, and fourth guide members being vertically aligned;

the upper retention member being superposed to the lower retention member and the first, second, third, and fourth guide members, the upper retention member being laterally offset from the plurality of guide members, the upper retention member being co-planar with the plurality of guide members in a plane parallel to the mounting plate;

the lower retention member being superposed to the first, second, third, and fourth guide members, the lower retention member being laterally offset from the plurality of guide members, the lower retention member being co-planar with the plurality of guide members in the plane parallel to the mounting plate;

a receiving member configured to be mounted in the door sill, the receiving member being vertically aligned with the plurality of guide members;

the continuous cane rod having the handle coupled to a shaft having a heel, the handle having a horizontal axis and the shaft having a vertical axis;

a spring washer mounted on the continuous cane rod subjacent to the second guide member;

a spring mounted on the continuous cane rod and interposed between the spring washer and the third guide member, the spring urging the continuous cane rod axially and vertically toward the upper retention member until the spring urges the spring washer into contact with the second guide member, the spring washer dampening the contact therebetween;

in an open configuration, the handle of the continuous cane rod being releasably retained by the upper retention member between the upper and lower parallel planar plates thereof, with the shaft slidably extending axially through the first, second, third, and fourth guide members with the heel of the continuous cane rod spatially separated from the receiving member;

in a locked configuration, the handle of the continuous cane rod being releasably retained by the lower retention member between the upper and lower parallel planar plates thereof, with the shaft slidably extending axially through the plurality of guide members with the heel of the continuous cane rod penetrating the receiving member;

the continuous cane rod transitioning from the open configuration to the locked configuration by radial displacement of the handle of the continuous cane rod away from the upper retention member, vertical displacement of the shaft such that the heel penetrates the receiving member, and radial displacement of the handle of the continuous cane rod to the lower retention member such that the handle is releasably retained by the lower retention member; and the continuous cane rod transitioning from the locked configuration to the open configuration by radial displacement of the handle of the continuous cane rod away from the lower retention member, vertical displacement of the shaft such that the heel retreats from the receiving member with a spatial separation therebetween, and radial displacement of the handle of the continuous cane rod toward the upper retention member such that the handle is releasably retained by the upper retention member.

2. The door locking system as recited in claim 1, wherein the spring washer further comprises a plastic material.

3. The door locking system as recited in claim 1, wherein each of the first, second, third, and fourth guide members comprise an eyebolt.

4. The door locking system as recited in claim 1, wherein each of the first, second, third, and fourth guide members are coupled to the front surface of the mounting plate by welding.

5. The door locking system as recited in claim 1, wherein the shaft of the continuous cane rod has a midpoint with the first guide member being superior to the midpoint of the shaft and the second, third, and fourth guide members being inferior to the midpoint of the shaft.

6. A door locking system for integrating into an entry door having a hardware therein and a door sill, the door locking system comprising:

a mounting plate including a front surface, a rear surface, an upper edge, a lower edge, and two side edges, the rear surface of the mounting plate configured to be mounted to the entry door proximate an intersection of a lock stile and a bottom rail;

an upper retention member coupled to the front surface of the mounting plate, the upper retention member including upper and lower planar parallel plates, the upper and lower planar parallel plates configured to releasably retain a handle of a continuous cane rod therebetween;

a lower retention member coupled to the front surface of the mounting plate, the lower retention member including upper and lower planar parallel plates, the upper and lower planar parallel plates configured to releasably retain the handle of the continuous cane rod therebetween;

a plurality of guide members including first, second, third, and fourth guide members coupled to the front surface of the mounting plate by welding, the first, second, third, and fourth guide members being vertically aligned, each of the first, second, third, and fourth guide members being an eyebolt;

the upper retention member being superposed to the lower retention member and the first, second, third, and fourth guide members, the upper retention member being laterally offset from the plurality of guide members, the upper retention member being co-planar with the plurality of guide members in a plane parallel to the mounting plate;

the lower retention member being superposed to the first, second, third, and fourth guide members, the lower retention member being laterally offset from the plurality of guide members, the lower retention member being co-planar with the plurality of guide members in the plane parallel to the mounting plate;

a receiving member configured to be mounted in the door sill, the receiving member being vertically aligned with the plurality of guide members;

the continuous cane rod having the handle coupled to a shaft having a heel, the handle having a horizontal axis and the shaft having a vertical axis;

a spring washer mounted on the continuous cane rod subjacent to the second guide member, the spring washer being a plastic material;

a spring mounted on the continuous cane rod and interposed between the third guide member and the spring washer, the spring urging the continuous cane rod axially and vertically toward the upper retention member until the spring urges the spring washer into contact with the second guide member, the spring washer dampening the contact therebetween;

in an open configuration, the handle of the continuous cane rod being releasably retained by the upper retention member between the upper and lower parallel planar plates thereof, with the shaft slidably extending axially through the first, second, third, and fourth guide members with the heel of the continuous cane rod spatially separated from the receiving member, in the open configuration, the handle of the continuous cane rod being spring biased against the upper retention member;

in a locked configuration, the handle of the continuous cane rod being releasably retained by the lower retention member between the upper and lower parallel planar plates thereof, with the shaft slidably extending axially through the plurality of guide members with the heel of the continuous cane rod penetrating the receiving member, in the locked configuration, the handle of the continuous cane rod being spring biased against the lower retention member;

the continuous cane rod transitioning from the open configuration to the locked configuration by initial radial displacement of the handle of the continuous cane rod away from the upper retention member, vertical displacement of the shaft such that the heel penetrates the receiving member, and radial displacement of the handle of the continuous cane rod to the lower retention member such that the handle is releasably retained by the lower retention member; and the continuous cane rod transitioning from the locked configuration to the open configuration by initial radial displacement of the handle of the continuous cane rod away from the lower retention member, vertical displacement of the shaft such that the heel retreats from the receiving member with a spatial separation therebetween, and radial displacement of the handle of the continuous cane rod toward the upper retention member such that the handle is releasably retained by the upper retention member.

7. A door locking system for integrating into an entry door having a hardware therein and a door sill, the door locking system comprising:

a mounting plate including a front surface, a rear surface, an upper edge, a lower edge, and two side edges, the rear surface of the mounting plate configured to be mounted to the entry door proximate an intersection of a lock stile and a bottom rail;

an upper retention member coupled to the front surface of the mounting plate, the upper retention member including upper and lower planar parallel plates, the upper and lower planar parallel plates configured to releasably retain a handle of a continuous cane rod therebetween;

a lower retention member coupled to the front surface of the mounting plate, the lower retention member including upper and lower planar parallel plates, the upper and lower planar parallel plates configured to releasably retain the handle of the continuous cane rod therebetween;

a plurality of guide members including first, second, third, and fourth guide members coupled to the front surface of the mounting plate by welding from the lower edge to the upper edge, the first, second, third, and fourth guide members being vertically aligned, each of the first, second, third, and fourth guide members being an eyebolt;

the upper retention member being superposed to the lower retention member and the first, second, third, and fourth guide members, the upper retention member being laterally offset from the plurality of guide members, the upper retention member being co-planar with the plurality of guide members in a plane parallel to the mounting plate;

the lower retention member being superposed to the first, second, third, and fourth guide members, the lower retention member being laterally offset from the plurality of guide members, the lower retention member being co-planar with the plurality of guide members in the plane parallel to the mounting plate;

a receiving member configured to mounted in the door sill, the receiving member being vertically aligned with the plurality of guide members;

the continuous cane rod having the handle coupled to a shaft having a heel, the handle having a horizontal axis and the shaft having a vertical axis, the shaft of the continuous cane rod having a midpoint;

the first guide member being superior to the midpoint of the shaft and the second, third, and fourth guide members being inferior to the midpoint of the shaft;

a spring washer mounted on the continuous cane rod subjacent to the second guide member, the spring washer being a plastic material;

a spring mounted on the continuous cane rod and interposed between the third guide member and the spring washer, the spring urging the continuous cane rod axially and vertically toward the upper retention member until the spring urges the spring washer into contact with the second guide member, the spring washer dampening the contact therebetween;

in an open configuration, the handle of the continuous cane rod being releasably retained by the upper retention member between the upper and lower parallel planar plates thereof, with the shaft slidably extending axially through the first, second, third, and fourth guide members with the heel of the continuous cane rod spatially separated from the receiving member, in the open configuration, the handle of the continuous cane rod being spring biased against the upper retention member;

in a locked configuration, the handle of the continuous cane rod being releasably retained by the lower retention member between the upper and lower parallel planar plates thereof, with the shaft slidably extending axially through the plurality of guide members with the heel of the continuous cane rod penetrating the receiving member, in the locked configuration, the handle of the continuous cane rod being spring biased against the lower retention member;

the continuous cane rod transitioning from the open configuration to the locked configuration by initial radial displacement of the handle of the continuous cane rod away from the upper retention member, vertical displacement of the shaft such that the heel penetrates the receiving member, and radial displacement of the handle of the continuous cane rod to the lower retention member such that the handle is releasably retained by the lower retention member; and the continuous cane rod transitioning from the locked configuration to the open configuration by initial radial displacement of the handle of the continuous cane rod away from the lower retention member, vertical displacement of the shaft such that the heel retreats from the receiving member with a spatial separation therebetween, and radial displacement of the handle of the continuous cane rod toward the upper retention member such that the handle is releasably retained by the upper retention member.

* * * * *